US007364139B2

(12) United States Patent
Bollons

(10) Patent No.: US 7,364,139 B2
(45) Date of Patent: Apr. 29, 2008

(54) CARBURETORS

(76) Inventor: Bernard Bollons, 3 Quineys Road, Shottery, Stratford CV37 9BW (GB)

( * ) Notice: Subject to any disclaimer, the term of this patent is extended or adjusted under 35 U.S.C. 154(b) by 49 days.

(21) Appl. No.: 11/409,492

(22) Filed: Apr. 21, 2006

(65) Prior Publication Data

US 2006/0237862 A1 Oct. 26, 2006

(30) Foreign Application Priority Data

Apr. 22, 2005 (GB) ..... 0508106.2

(51) Int. Cl.
*F02M 15/04* (2006.01)

(52) U.S. Cl. ..... 261/39.6; 137/341; 261/129; 261/130; 261/131; 261/DIG. 2; 261/DIG. 20

(58) Field of Classification Search ..... 261/26, 261/39.6, 64.1, 65, 142, DIG. 2, DIG. 20, 261/129–131, 39.1; 137/341; 123/549
See application file for complete search history.

(56) References Cited

U.S. PATENT DOCUMENTS 1,422,896 A 7/1922 Soreng
2,658,734 A * 11/1953 Henning ..... 261/41.5
2,719,519 A * 10/1955 Sutton ..... 123/543
3,916,859 A * 11/1975 Fossum ..... 123/546
4,816,192 A * 3/1989 Abou-Aly et al. ..... 261/130
5,209,211 A * 5/1993 Kopp et al. ..... 123/549
2003/0178064 A1 9/2003 Fukuda et al.

FOREIGN PATENT DOCUMENTS

| | | |
|---|---|---|
| FR | 542017 | 5/1922 |
| GB | 1117843 | 6/1968 |
| GB | 2037894 | 7/1980 |
| JP | 06101777 | 4/1994 |

* cited by examiner

*Primary Examiner*—Richard L. Chiesa
(74) *Attorney, Agent, or Firm*—Davis Bujold & Daniels, P.L.L.C.

(57) ABSTRACT

A carburetor having a throttle valve in the form of a disc which can be rotated to control flow of an air/fuel mixture through a duct, the throttle disc having a heating element and a temperature sensor formed on at least one surface of said throttle disc; and an electric power supply, the electric power supply being controlled by the temperature sensor, to maintain the temperature of the throttle disc above a predetermined minimum temperature.

12 Claims, 2 Drawing Sheets

CARBURETORS

This application claims priority from British Application Ser. No. 0508106.2 filed Apr. 22, 2005.

FIELD OF THE INVENTION

The present invention relates to carburetors and in particular carburetors with a throttle control valve in the form of a disc which can be rotated to control the flow of air/fuel mixture into an internal combustion engine and where the fuel jet is situated upstream of the throttle valve.

BACKGROUND OF THE INVENTION

The invention offers a solution to the phenomenon known as carburetor icing associated with this type of carburetor. Carburetor icing has been a problem for many decades but the mechanism for ice formation in a throttle plate carburetor does not seem to have been fully understood. The inventor believes the mechanism for ice formation to be as described below.

In this type of carburetor, a fuel mist issues from the jet. Normally the fuel is atomised by means of a venturi and the air flow through the carburetor, to set up the required fuel-air ratio for correct running of the engine.

Due to the pressure drop developed across the throttle plate a partial vacuum is formed around the throttle plate disc, thus causing the atomised fuel to turn to vapour, thereby cooling the fuel air mixture by the latent heat of vaporisation.

The cooling effect of the vaporisation of the fuel is instantaneous and significant. It sets up a temperature gradient of 20-30° C. around the throttle plate and under certain relative humidity conditions and intermediate throttle angles, and hence air flow rates, ice will rapidly form on the throttle plate and associated metal parts of the carburetor. This partial obstruction of the airflow, due to ice formation, can lead to the fuel/air ratio altering to such an extent that the mixture becomes too rich and the engine will stop in a matter of seconds. This is a highly undesirable situation, especially for single engine aircraft. Hitherto, this problem has been addressed by either heating the carburetor body or heating the air before it enters the carburetor. These methods are a compromise and will not prevent icing under all conditions. These methods furthermore require large amounts of heat to effectively prevent icing, demanding a compromise between engine power and effective ice prevention. For this reason most designs require the system to be manually engaged by the pilot, as stated in the aircraft flight manual, and are susceptible to pilot error. Both of these methods can reduce the engine power by as much as 15-20% and as such are only engaged when maximum power from the engine is not essential.

SUMMARY OF THE INVENTION

The present invention provides, a carburetor including a throttle valve in the form of a disc which can be rotated to control flow of an air/fuel mixture through a duct, the throttle disc having a heating element and a temperature sensor formed on at least one surface of said throttle disc; and an electric power source, the electric power source being controlled by the temperature sensor, to maintain the temperature of the throttle disc above a predetermined minimum temperature.

In this manner, the throttle disc is heated directly thereby avoiding heat losses associated with the methods used hitherto. Moreover, the temperature sensor continuously monitors the temperature of the throttle disc, so that the heating element is only energised when required. Consequently, when the circuit is quiescant, when icing is not a problem, the power consumption is minute and the system can be left permanently connected to the aircraft electrical supply so that pilot intervention is not required.

Furthermore, the heat required and hence power consumed to keep the throttle plate ice free is a fraction of that required to heat either the carburetor body or the fuel/air mixture, thereby allowing maximum engine power to be achieved under any likely icing conditions.

According to a preferred embodiment of the invention, the heating element is a thick film element which is deposited on the surface of the metal throttle disc. This type of heating element provides a very rapid response which may be in excess of 20° C. per second.

The temperature sensor is preferably a planar diode giving a voltage linear proportional to temperature, a response time of the order of 10 ms and resolution of the order of 0.01° C.

A pulsed DC power supply is preferably used to energise the heating element, the width of the pulses being controlled to decrease proportionally as the temperature of the throttle disc rises from the predetermined minimum value to a second predetermined value.

BRIEF DESCRIPTION OF THE DRAWINGS

The invention is now described by way of example only, with reference to the accompanying drawings, in which.

DETAILED DESCRIPTION OF THE INVENTION

Figure 1:
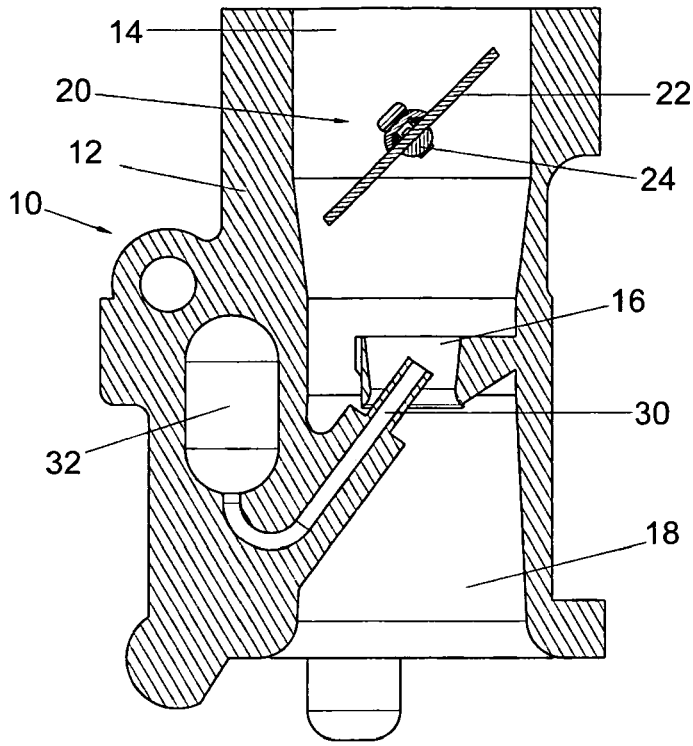
FIG. 1 is a cross-section through a carburetor.

As illustrated in FIG. 1, a carburetor 10 has a body 12 which defines a duct 14, being connected to an inlet manifold of an internal combustion engine and being open at the other end 18 to a supply of air.

A throttle valve 20 is located intermediate of the duct 14, the throttle valve 20 comprising a stainless steel disc 22 mounted on a hollow spindle 24, for rotation through 90°, about an axis diametrical of the duct 14. In this manner, the disc 22 can be rotated between a position in which it is disposed substantially perpendicular to the longitudinal axis of the duct 14 and substantially closes the duct 14; and a position in which it lies parallel to the axis of the duct 14, and causes minimal obstruction to flow of air/fuel mixture through the duct 14.

A fuel jet 30 is located intermediate of the throttle valve 20 and the end 18 of duct 14 open to the air supply. The fuel jet 30 opens at one end into the venturi 16 and at the other end to a fuel chamber 32 defined by the body 12 of the carburetor 10, so that air flowing over the jet 30 will draw fuel from the chamber 32 atomising the fuel so that it mixes with the flow of air.

Figure 2:
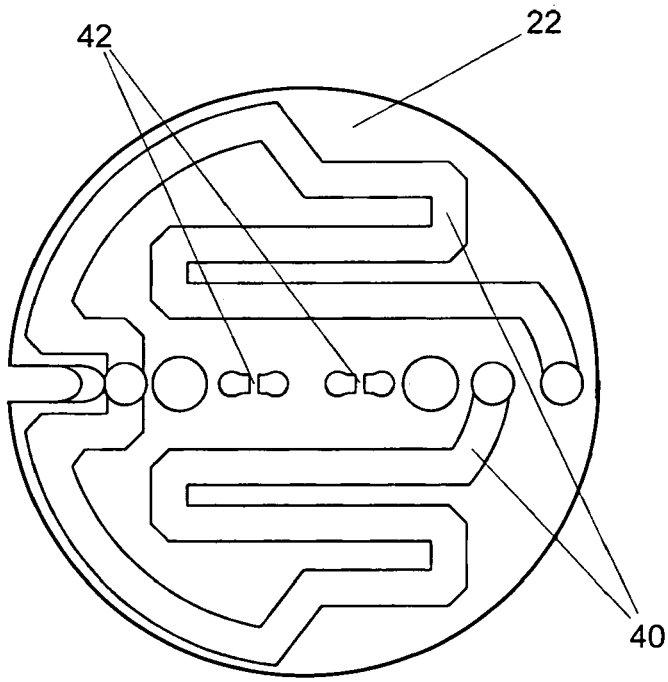
FIG. 2 is an enlarged plan view of the throttle disc of the carburetor illustrated in FIG. 1.

As illustrated in FIG. 2, a thick film heating element 40 and a planar diode 42 are deposited on one surface of the disc 22, with a permanent hard over-glaze. The thick film heating element 40 and planar diode 42 are connected to a DC power supply/control circuit 44, as described in detail with reference to FIG. 3, by means or wires, which are taken to the outside of the carburetor body 12, through the hollow spindle 24, directly to the control circuit, which control circuit being small and of negligible mass, is mounted co-axially and integral with the throttle spindle so that only two supply wires are required to connect to the 28 VDC supply.

Figure 3:
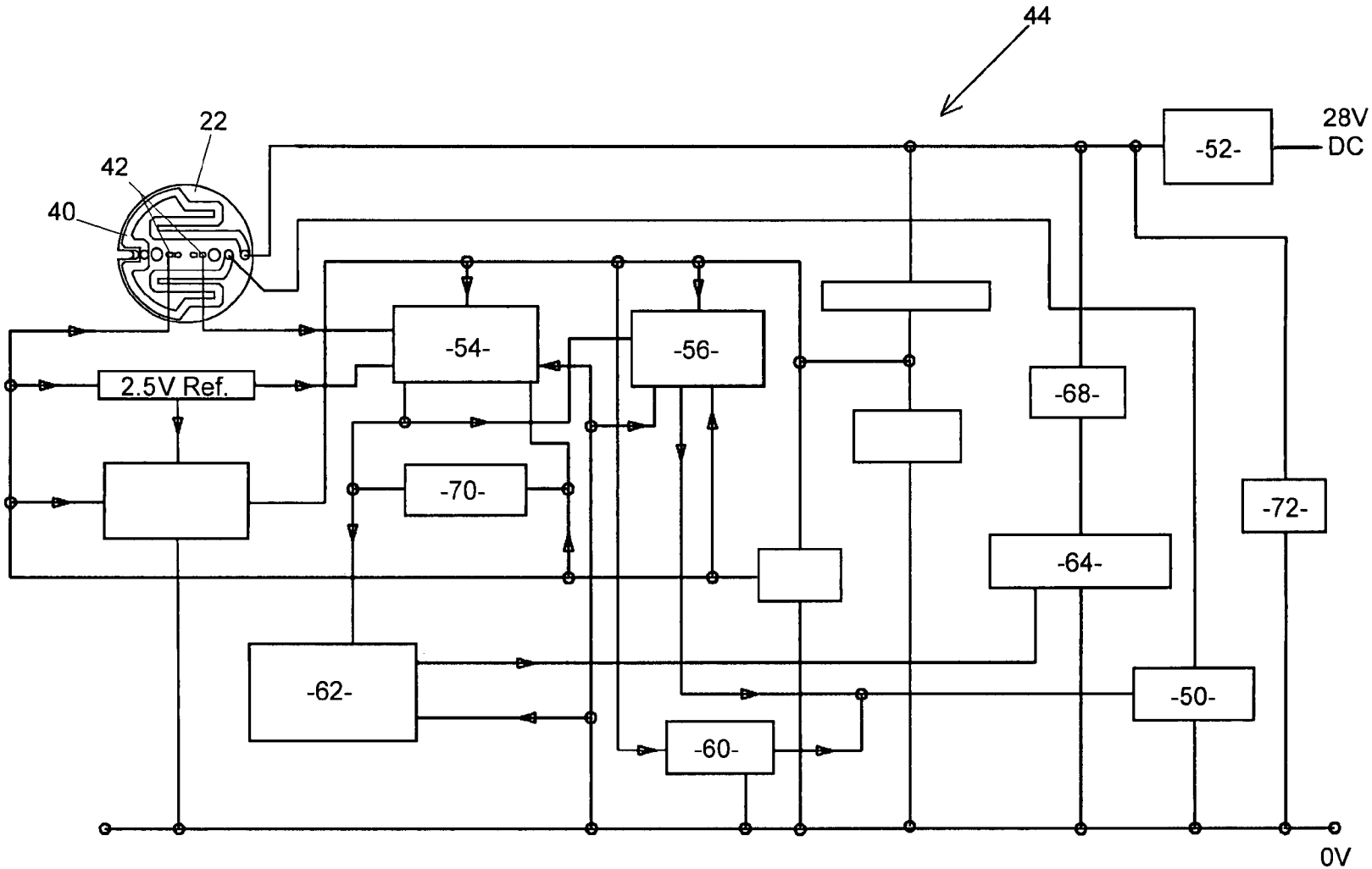
FIG. 3 is a block diagram of the power control circuit for the carburetor illustrated in FIG. 1.

As illustrated in FIG. 3, the DC power supply/control circuit 44 comprises a 28 volt DC supply. The heating element 40 is connected across the DC supply in series with a mosfet transistor 50 which controls connection of the heating element 40 to the DC supply.

A reverse polarity protection device 52 which consists of a low forward volt drop blocking diode, is provided in the DC supply, to prevent damage to the controller in the event of incorrect connections during installation.

The signal from the temperature sensor 42, the voltage of which is proportional to the temperature of the throttle disc 14, is compared with a 2.5 volt reference signal, by means of a differential amplifier 54. The differential amplifier 54 generates an error signal, which increases as the throttle disc 14 cools. The error signal of the differential amplifier 54 controls a pulse width modulator 56. The pulse width modulator 56 produces pulses at a frequency of the order of 100 pulses per second. The width of the pulses, that is the on time, increases with the error signal so that at the predetermined minimum temperature, typically 2° C., the pulse width will be at a maximum, while at a second predetermined temperature, typically 10° C. the pulse width will be zero.

The pulses from the pulse width modulator 56 control the mosfet transistor 50, switching on the mosfet transistor 50 and connecting the heater element 40 to the 28 volt DC supply. In this manner, the heat produced by the heating element 40 will be at a maximum (fully on) when the temperature of a plate is at the predetermined minimum value and will reduce proportionally as the temperature rises, until at the second predetermined temperature the heating element 40 will be turned off.

A power up detector 60 is also provided in the circuit which will switch the mosfet transistor 50 on for a period of two seconds after power up of the system to connect the heating element 40 to the DC supply. During this period a differentiator and threshold detector 62 monitors the error signal from the differential amplifier 54 and when the rate of change of the throttle plate temperature exceeds 10° C./second, turns switch 64 on to illuminate a cockpit LED self test indicator 68.

The circuit also includes a display logger 70 which is connected to the differential amplifier 54 to provide a digital readout and log of the throttle disc temperature. A cockpit power supply LED indicator 72 also provides an indication that the system is correctly connected to the DC supply.

Various modifications may be made without departing from the invention. For example, the characteristics of the heating element and temperature sensor are provided by way of example only and other heating elements and temperature sensors may be used which will provide sufficient heat and a sufficient response time to prevent icing of the carburetor.

A second temperature sensor, for example planar diode may be provided on the throttle disc, to check proper functioning of planar diode 42 and provide an indication to the pilot, if there is a malfunction.

The invention claimed is:

1. A carburetor including a throttle valve in the form of a disc which can be rotated to control flow of an air/fuel mixture through a duct, the throttle disc having a heating element and a temperature sensor formed on at least one surface of said throttle disc; and an electric power supply, the electric power supply being controlled by the temperature sensor, to maintain the temperature of the throttle disc above a predetermined minimum temperature, and the temperature sensor has a response time of the order of 10 ms and a resolution of the order of 0.01° C.

2. The carburetor according to claim 1, wherein the heating element is a thick film element.

3. The carburetor according to claim 1, wherein the throttle disc is formed from stainless steel.

4. The carburetor according to claim 1, wherein the temperature sensor is a planar diode.

5. The carburetor according to claim 1, wherein the first predetermined temperature is of the order of 2° C.

6. The carburetor according to claim 1, wherein a pulsed power supply is used to energise the heating element.

7. The carburetor according to claim 6, wherein the width of the pulses decreases proportionally as the temperature of the throttle disc rises from the predetermined minimum temperature to a second predetermined value.

8. The carburetor according to claim 7, wherein the second predetermined temperature is of the order of 10° C.

9. The carburetor according to claim 6, wherein the pulse width is at a maximum when the throttle disc temperature is at the predetermined minimum temperature and is zero when the throttle disc temperature is at the second predetermined temperature.

10. The carburetor according to claim 1, wherein the power supply/control circuit includes a self test circuit, which switches on the heating element for a predetermined period, at power up of the system, and provides an indication of correct functioning if the rate of change in throttle plate temperature exceeds a predetermined value.

11. The carburetor according to claim 8, wherein the predetermined rate of change of throttle plate temperature is of the order of 10° C./sec.

12. The carburetor, according to claim 1, wherein the throttle disc is mounted on a spindle, a control circuit being an integral part of the throttle spindle and/or an actuator lever for rotation of the spindle, thereby minimising the wires to be connected to the electric power supply.

* * * * *